US006013132A

United States Patent [19]

Tramont

[11] Patent Number: 6,013,132

[45] Date of Patent: Jan. 11, 2000

[54] PAINT ROLLER WITH MASKED SURFACE

[76] Inventor: Thomas J. Tramont, 46 Ridgewood Rd., West Hartford, Conn. 06107

[ * ] Notice: This patent is subject to a terminal disclaimer.

[21] Appl. No.: 08/889,555

[22] Filed: Jul. 8, 1997

Related U.S. Application Data

[63] Continuation-in-part of application No. 08/505,779, Jul. 21, 1995, Pat. No. 5,693,141.

[51] Int. Cl.[7] ..... B05C 1/00

[52] U.S. Cl. ..... 118/211; 118/244; 118/256; 118/258; 118/264; 118/DIG. 14; 118/DIG. 15; 15/210.5; 15/230.11

[58] Field of Search ..... 118/211, 244, 118/256, 258, 264, DIG. 14, DIG. 15; 492/19, 20, 30, 55, 56; 29/895.3; 15/210.5, 230.11

[56] References Cited

U.S. PATENT DOCUMENTS

| | | | |
|---|---|---|---|
| D. 173,162 | 10/1954 | Knapp, Jr. | D9/2 |
| D. 173,312 | 10/1954 | Knapp, Jr. | D9/2 |
| D. 287,312 | 12/1986 | Hori | D4/123 |
| 1,903,152 | 3/1933 | Watson et al. | 15/248.2 |
| 2,805,436 | 9/1957 | Christensen et al. | 15/132.5 |
| 3,090,301 | 5/1963 | Arounowa | 101/134 |
| 3,955,260 | 5/1976 | Sherden | 118/DIG. 15 |
| 4,191,792 | 3/1980 | Janssen | 427/260 |
| 4,257,140 | 3/1981 | Downing | 15/230.11 |
| 4,404,703 | 9/1983 | Woodall, Jr. et al. | 15/230.11 |
| 4,756,065 | 7/1988 | Carlson | 492/52 |
| 4,919,975 | 4/1990 | Jones | 427/260 |
| 4,930,179 | 6/1990 | Wright et al. | 15/230.11 |
| 5,117,529 | 6/1992 | Ohta | 15/230.11 |
| 5,206,979 | 5/1993 | Campbell | 15/230.11 |
| 5,471,703 | 12/1995 | Niven | 15/210.5 |
| 5,693,141 | 12/1997 | Tramont | 118/211 |

FOREIGN PATENT DOCUMENTS

| | | | |
|---|---|---|---|
| 890/31 | 10/1931 | Australia | 15/210.5 |
| 604630 | 7/1948 | United Kingdom . | |
| 2 132 577 | 10/1983 | United Kingdom . | |

OTHER PUBLICATIONS

"A Guide to Decorative Paint Techniques", Brochure, McCloskey, JT #427/94, undated.

"The Personality of Color," Brochure, Pratt & Lambert Paints No. 010–6200–047, undated.

"How to Create Fantasy Finishes With Flair & Imagination", Brochure, Benjamin Moore Paints, No. 070–116, Printed in Canada, Jan. 1991.

"Decorative Painting Brushes & Tools for the Specialist Painter", Brochure—Old World Brush & Tool Co., St. Charles, MO, undated.

"Graham Designer Series", Waterbourne Faux Finish System, One Sheet Advertising, undated.

"The Future is Multicolored"—Spectura–Surface Protection Industries International, North Billerica, Ma—One Sheet Advertising, undated.

"Decorators' Partnership Appeals to Wider Range of Tastes," Newspaper Article, The Harford Conrant, p. B–1, Jun. 21, 1995.

*Primary Examiner*—Laura Edwards

*Attorney, Agent, or Firm*—Alix, Yale & Ristas, LLP

[57] ABSTRACT

In a paint roller having an inner core with an outer annular surface and a radially resilient, substantially cylindrical paint roller medium extending around and affixed to the inner core for rotation therewith, the improvement wherein the outer medium has a substantially uniform outer diameter and comprises a base of resilient porous material, and a distribution of non-porous material which masks portions of the base. Preferably the distribution of non-porous material is random.

7 Claims, 2 Drawing Sheets

PAINT ROLLER WITH MASKED SURFACE

RELATED APPLICATION

This is a continuation-in-part application of U.S. application Ser. No. 08/505,779, filed Jul. 21, 1995 entitled "Special Effect Paint Roller", now U.S. Pat. No. 5,693,141, for which benefit under 35 U.S.C. §120 is claimed.

BACKGROUND OF INVENTION

The present invention relates to a new and improved paint roller having an outer paint roll medium configured and constructed to produce a special effect when the paint roller is rolled over a work surface.

DESCRIPTION OF PRIOR ART

Conventional rollers have a core and an outer, annular, paint roll medium surrounding the core. The core has a central axis of rotation and an outer annular surface, typically made by cutting off selected lengths of tubular core stock. The core typically has a cylindrical outer surface. For example, the roller core can have a length of 9 inches, a relatively large (e.g., approximately 1½ inch diameter) axial opening and a thin rigid tubular wall (e.g., having a thickness of approximately ⅛ inch). The axial opening in the roller core is provided for mounting the paint roller on a conventional paint roll handle. Therefore, a paint roller handle can be employed in a generally conventional manner for manually rolling the paint roller over a work surface with the outer paint roll medium engaging the work surface with a selected force. The outer, annular paint roll medium of each paint roller is affixed to the roller core in a manner which maintains the shape of the outer medium and ensures that the outer medium and roller core rotate together as the paint roller is rolled over a work surface.

The art of producing "faux" finishes and other special effects is centuries old. It is experiencing a rebirth and is a popular decorating technique today. For example, rollers have been proposed or used for producing patterns of flowers, stars and hearts. The paint rollers have hard, raised ribs or ridges for producing a pattern of specific shapes or a wood grain or other similar finish. See, for example U.S. Design Pat. No. 287,312, granted Dec. 23, 1986 and entitled "Paint Roller". Such rollers work best by applying a uniform force on the paint roller and rolling the paint roller in one direction across the work surface.

Make-shift, labor intensive procedures have been and are currently being used to produce irregular patterns or finishes. Sponge painting and rag painting are probably the most prevalent. In sponge painting, a sponge is manually dabbed against the work surface to apply or remove paint. In rag painting, a piece of cloth or other similar material is bunched up and then dabbed or rolled over a work surface to apply or remove paint. In a "dragging" procedure, a comb or other article is dragged over a wet paint surface to produce lines in the painted surface. In a "smoozing" procedure, separate spots of wet paint of different colors are brushed together with a dry brush to blend the spots together. Multicolor paints, which are now available, are used with one or more of the foregoing procedures to produce a speckled effect. All of these techniques are difficult, messy and time consuming. They require a high degree of dexterity and artistic skill.

SUMMARY OF INVENTION

According to the present invention, a paint roller is provided, having a base of resilient porous material, and a distribution of nonporous material which adheres to and masks portions of the base. In effect, the paint roller has conventional, porous sections, which are masked by the non-porous material.

In one embodiment of the invention, the non-porous material has no discernable pattern, whereas in another embodiment, the non-porous material has a discernable pattern. The non-discernable pattern is preferably random over at least about 10% of the surface of the roller. This type of roller produces a "mist" or "shadow" effect on the target surface. In the embodiment having a discernable pattern, the distribution of non-porous material can cover all of the base except for at least one discrete region defining a graphic figure. In this embodiment, the graphic figure absorbs paint and can be transferred to the painted surface in recognizable form.

Preferably, the inner core of the paint roller is designed for mounting the paint roller on a paint roller handle so that the paint roller can be manually rolled over a work surface with the handle in a conventional manner.

The present invention is relatively easy to use and is particularly suited for the "do-it-yourself" painter having limited experience. The invention enables a painter to produce a special effect considerably faster than sponge painting or rag painting. Also, the present invention helps overcome the difficulty encountered in sponge painting of achieving uniform effect over the entire work surface due to the application of paint to one small area at a time. With the present invention, an overall uniform effect is easier to achieve. Further, the present invention enables the painter to cover a large area quickly so that the paint does not dry before the desired effect is achieved on the entire area—thereby overcoming a major problem encountered in sponge or rag painting, particularly in the negative mode of painting.

A paint roller according to the present invention has notable use in painting a "faux" finish or other special effect on a large surface area such as a wall or ceiling, but may also be used to produce a special effect on other surfaces such as the relatively flat surfaces of furniture and picture, window and door frames.

The first embodiment of the present invention is primarily useful in producing an overall effect—not to produce an exact pattern or reproduction of a specific shape or finish. The present invention is useful in producing an effect which can be changed by varying the roller force, by varying the rolling direction, and by rolling the paint roller over the same area two or more times in the same or different directions.

A principal aim of the present invention is to provide a new and improved paint roller which can be manually rolled over a work surface to produce a "faux" finish or other special effect of the type conventionally produced by sponge or rag painting.

Another aim of the present invention is to provide a new and improved paint roller which can be mounted on and manipulated by a paint roller handle to produce a special effect relatively quickly by manually rolling the paint roller over a work surface with the outer medium of the paint roller engaging the work surface with a selected force.

It is another aim of the present invention to provide a new and improved paint roller having an outer paint roll medium constructed to apply paint to the work surface in the positive mode of painting and at the same time mark the wet paint surface in the negative mode of painting.

Other objects will be in part obvious and in part pointed out more in detail hereinafter.

A better understanding of the invention will be obtained from the following detailed description and the accompanying drawings of illustrative applications of the invention.

DESCRIPTION OF PREFERRED EMBODIMENTS

Figure 1:
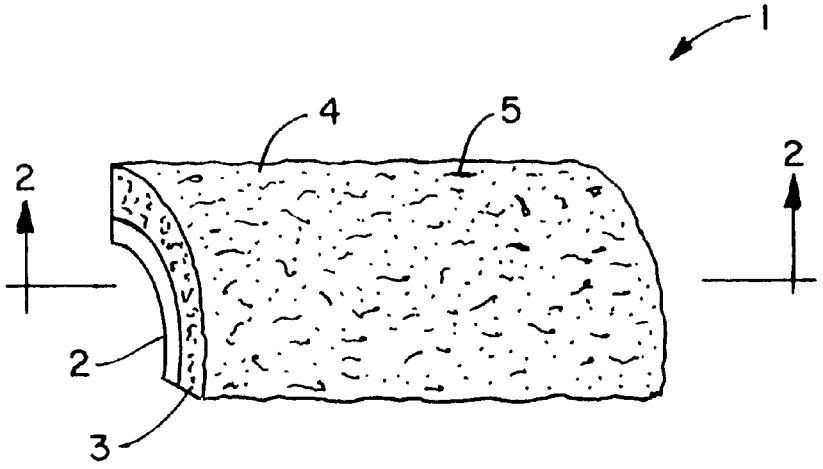
FIG. 1 is a perspective view of the exterior quadrant of a paint roller according to a first embodiment of the present invention.

In the drawings, like numerals are used to designate the same or like parts.

The present invention is in some respects an improvement relative to the invention described and claimed in the inventor's own prior U.S. patent application Ser. No. 08/505,779, the disclosure of which is hereby incorporated by reference.

Figure 2:
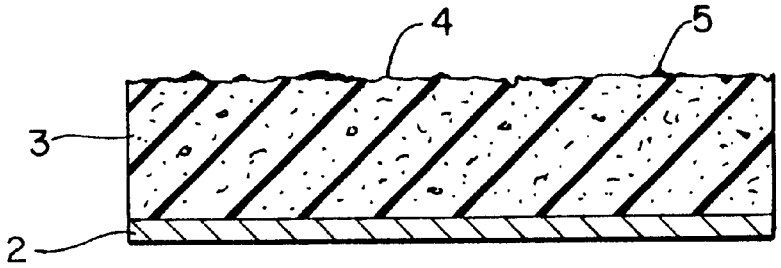
FIG. 2 is a section view taken along line 2—2 of FIG. 1.
Figure 3:
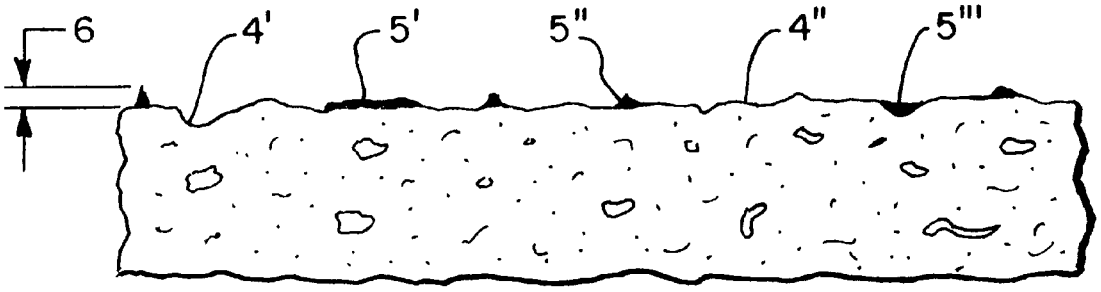
FIG. 3 is an enlarged view of the surface portion of the paint roller as depicted in FIGS. 1 and 2.

FIGS. 1–3 depict the inventive concept, for an improved, special effect paint roller 1 (only a quadrant of which is shown), having an inner core 2 with an annular, radially resilient, substantially cylindrical paint roll medium 3 extending around and affixed to the inner core 2 for rotation therewith. The outer medium 3 can be considered a base of resilient porous material, having a substantially uniform outer diameter, which presents a porous outer surface 4. According to the invention a distribution of non-porous material 5, adheres to and masks portions of the surface 4 of the base 3. In the embodiment shown in FIG. 1, the distribution of non-porous material 5 is substantially random on the porous surface 4.

A longitudinal-section of the roller 1, is shown in FIG. 2. The surface 4 of the porous base 3 is generally of a uniform diameter, although upon close inspection it is somewhat rough due to the normal surface irregularities typical of conventional rollers in which the paint roll medium may be hair, cotton, wool, sponge, etc. FIG. 2 also shows that the non-porous material 5, although covering and adhering to portions of the porous surface of the medium 3, does not project a significant distance thereabove. In this manner, the non-porous material masks portions, in this case random portions, of the porous base 3.

FIG. 3 shows an enlarged, typical detail of the surface of the roller 1 shown in FIG. 2. At the scale of FIG. 3, the surface profile of the porous material can include pores or depressions 4', and rises 4". The non-porous material can appear as a substantially flat deposit 5', a peak or cone 5", or a deposit 5'" which fills a depression or pore. Generally, the thickness or projection of the non-porous material such as at 5', 5", or 5'", should be no greater than about 1/16 inch from the mean diameter of the base 3 (not including pores 4'). The projection dimension is represented at 6 in FIG. 3.

The total surface area covered by the non-porous material 5, should be greater than about 10%, and ideally fall within the range of about 10%–50% of the entire outer surface (including pores 4') of the base material 3. The non-porous material 5, although typically harder in absolute terms than the base material surface 4, can, when deposited within the preferred thickness range, be considered resilient, i.e., it readily follows any deformation of the base material during the paint application process. Examples of the non-porous material 5 include silicone, butyl rubber, or glue.

The non-porous material 5 can be applied in a variety of ways, for example, by merely rolling the base medium 3 on a flat surface which has been previously coated with the non-porous material in liquid form. When left to dry, the non-porous material 5 adheres sufficiently to the porous material 4, so that when the roller 1 is used to paint a wall or the like, the non-porous material 5 remains adhered to, and masks, the underlying portions of the porous surface 4. Another possibility for applying the non-porous material, is by spraying. Furthermore, it should be appreciated that the term "non-porous material" does not necessarily mean that the non-porous material must be of a different chemical composition than the porous material. For example, the non-porosity might be achieved by heat or chemical treatment on the surface of the porous base material, thereby locally changing the density and other characteristics, to produce the desired non-porous (i.e., masking) effect. The heat or chemical treatment technique may be particularly effective for non-porous base material that is thermoplastic, or which has a very fine structure, such as felt.

In this context, "porous" means that paint is absorbed beneath the roller surface, thereby providing a reservoir for the supply of paint to the surface as it is rolled along a target surface, whereas "non-porous" means that although the material can be initially coated with paint, the paint thereon is not absorbed, but only transferred to the target surface.

This is not to say that the non-porous material does not influence the appearance of the paint on the surface against which the roller has been moved, but only that the porous surface areas do not participate in the storage and transmission of paint to the target surface.

When the roller 1 such as shown in FIG. 1 is used to apply paint to a large surface, such as a wall or ceiling, slight variations in applied paint density occur in random fashion, due to the random presence of the non-porous masking material 5. Although the masking effect is not complete, due to the slight pushing or "schmoozing" of paint by the mask material 5, there is nonetheless a relative masking in which the paint thickness applied to the wall varies, producing a subtle shadow or mist effect. The extent of this effect and the degree of subtlety, is dependent on the fraction of the surface area of the roller which is covered by the non-porous material 5, the size and/or average area of each deposit such as 5', 5" and 5'", and the force used while pushing the roller. A particularly pleasing effect is achieved when the distribution is random and non-uniform.

Figure 4:
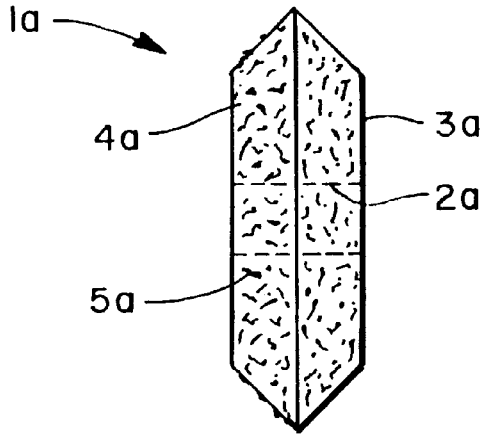
FIG. 4 is a side view of a variation of the roller depicted in FIGS. 1–3.

FIG. 4 shows a modification or variation to the roller of FIG. 1, for use in corners. The roll 1 a has a base annulus of porous material 3*a* which includes a through bore 2*a* (which may or may not be cored) for receiving a rotatable hub or the like (not shown). The base has a wedge-shaped outer surface as viewed perpendicularly to the rotation axis, i.e., the roller resembles a wedge wheel, or tapered grinding wheel. The porous surface 4*a* has non-porous material 5*a* adhering thereto, as described above with respect to FIG. 1.

Figure 5:
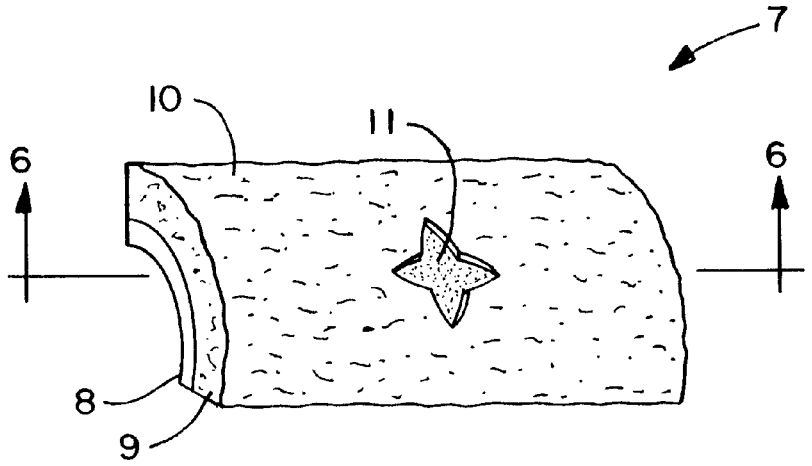
FIG. 5 is a perspective view of the exterior quadrant of a paint roller according to a second embodiment of the present invention.
Figure 6:
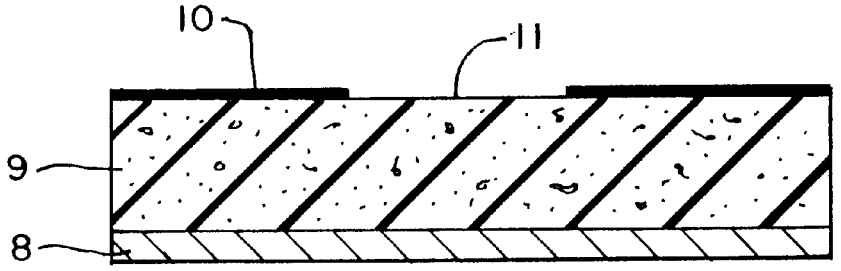
FIG. 6 is a section view taking along line 6-6 of FIG. 5.

FIGS. 5 and 6 show another embodiment, which does not produce a shadow effect, but rather produces a somewhat smeared background interspersed with discrete, bold characters or graphic figures. This embodiment 7 includes a core 8 and paint roll medium 9, corresponding to 2 and 3 of FIG. 1. In this embodiment, however, the entire surface of the porous material 9 is covered with non-porous material 10, except that at least one discrete region is left uncovered, thereby exposing the porous material 10 in the shape of the particular graphic, for example the stylized star shown in FIG. 5.

The roller of FIG. 5 is shown in longitudinal section in FIG. 6, where again it can be seen that the porous material 10 covers the entire surface of the medium 9, except for a discrete exposed region 11.

Rollers of the type shown in FIGS. 1, 4 and 5 could be used after the user paints the target surface in one color, i.e., the user goes back after that surface has dried fully, and rolls over it using the inventive roller with a different color. The rollers of FIGS. 1 and 4 can be used without another color, on a painted surface which has not yet dried. In other words, these rollers could be used either in a positive or negative technique.

When a paint roller is used in the positive mode of painting (or in both modes simultaneously), the outer medium is maintained relatively wet by periodically loading the outer medium with an appropriate amount of paint, preferably in a conventional manner by partly immersing the paint roller in a tray of paint and then rolling the paint roller across a surface of the tray or another suitable surface to remove excess paint from the outer medium and to spread the remaining paint generally evenly around the paint roller. The wet paint roller is then manually rolled over a dry work surface with a suitable force to roll paint from the outer medium onto the work surface.

In the negative mode of painting, the outer medium is maintained relatively dry and the paint roller is manually rolled over a work surface to which a suitable base coating of paint has just been applied and is still wet enough for both removing and moving the wet paint with the paint roller by rolling the paint roller over the work surface with a suitable force.

In the positive mode of painting, the paint may be a conventional paint or a colored glazing of the type employed in sponge and cloth painting. Where a colored glazing is used, an appropriate pigment is added to uncolored glazing to obtain the desired color. In the negative mode of painting, a colored glazing is preferably used.

Each paint roller can be employed to paint an irregular pattern of markings spaced relatively far apart or relatively close together, depending on the applied roller force and the number of times and different directions the paint roller is rolled over the work surface. After one pattern (e.g., in one color) is applied by one of the paint rollers and permitted to dry, a second pattern (e.g., in a different color) can be applied by the same or different paint roller and permitted to dry, etc. Thus, the effect achieved is a result of one or two or more separate and distinct painting stages, with each stage producing a selected pattern of a selected color. An unlimited number of variations and styles are possible, and the specific effect achieved is dependent on individual taste and creativity.

As indicated, each paint roller can be manually rolled over a work surface with a paint roller handle in a generally conventional manner. Accordingly, the user can apply a "faux" finish or other special effect to a large area relatively quickly and with ease. In each stage of application, the user can experiment on a small test area first. In the negative mode of painting, the test area is repainted with a base coating (e.g., with a conventional roller) before the selected effect is applied to the entire work surface. In the positive mode of painting, the test area is cleaned before the desired effect is applied to the entire work surface.

As will be apparent to persons skilled in the art, various modifications, adaptations and variations of the foregoing specific disclosure can be made without departing from the teachings of the present invention.

What is claimed is:

1. In a paint roller having an inner core with an outer annular surface and a radially resilient, substantially cylindrical paint roller medium extending around and affixed to the inner core for rotation therewith, the improvement wherein the outer medium comprises a base of resilient porous material having a mean diameter, and a random distribution of non-uniformly shaped, non-porous deposits of material, which mask portions of the base and project from the mean diameter of the base by no more than about 1/16 inch.

2. The paint roller of claim 1, wherein the distribution of non-porous material masks at least about 10 percent of the base material.

3. The paint roller of claim 1, wherein the distribution of nonporous material masks between about 10 and 50 percent of the base material.

4. The paint roller of claim 1, wherein the non-porous material has a different chemical composition from the base material and adheres to the base.

5. The paint roller of claim 1, wherein the non-porous material is resilient.

6. The paint roller of claim 1, wherein the non-porous material is selected from the group consisting of silicon, butyl rubber, and glue.

7. In a paint roller having an inner core with an outer annular surface and a radially resilient, substantially cylindrical paint roller medium extending around and affixed to the inner core for rotation therewith, the improvement wherein the outer medium has a substantially uniform outer diameter and comprises a base of resilient porous material, and a distribution of non-porous material which masks portions of the base, wherein the non-porous material has the same chemical composition as the base material.

* * * * *